US012029276B2

(12) United States Patent
Shin

(10) Patent No.: US 12,029,276 B2
(45) Date of Patent: Jul. 9, 2024

(54) EASY-TO-WEAR FUNCTIONAL SHOE

(71) Applicant: Sung Ne Shin, Chungju-si (KR)

(72) Inventor: Sung Ne Shin, Chungju-si (KR)

( * ) Notice: Subject to any disclaimer, the term of this patent is extended or adjusted under 35 U.S.C. 154(b) by 168 days.

(21) Appl. No.: 17/605,873

(22) PCT Filed: Apr. 22, 2020

(86) PCT No.: PCT/KR2020/005326
§ 371 (c)(1),
(2) Date: Oct. 22, 2021

(87) PCT Pub. No.: WO2020/218828
PCT Pub. Date: Oct. 29, 2020

(65) Prior Publication Data

US 2022/0240625 A1 Aug. 4, 2022

(30) Foreign Application Priority Data

Apr. 24, 2019 (KR) ..... 10-2019-0048102

(51) Int. Cl.
*A43B 23/08* (2006.01)

(52) U.S. Cl.
CPC ..... *A43B 23/08* (2013.01)

(58) Field of Classification Search
CPC ..... A43B 23/28; A43B 23/22; A43B 23/02; A43B 23/088; A43B 7/32
See application file for complete search history.

(56) References Cited

U.S. PATENT DOCUMENTS 471,476 A * 3/1892 Garcia ..... A43B 23/28 36/58.5
912,579 A * 2/1909 Krech et al. ..... A43B 23/28 36/68
1,018,652 A * 2/1912 Drechsler ..... A43B 23/28 36/58.5
1,020,160 A * 3/1912 Rowe ..... A43B 23/28 36/71
1,028,586 A * 6/1912 Rowe ..... A43B 23/28 36/58.5
1,086,673 A * 2/1914 Koppe ..... A43B 23/28 36/68
1,122,884 A * 12/1914 Eliason et al. ..... A43B 23/07 36/55

(Continued)

FOREIGN PATENT DOCUMENTS

JP 3212460 U 9/2017
KR 10-0713700 B1 5/2007

(Continued)

OTHER PUBLICATIONS

International Search Report of PCT/KR2020/005326 dated Aug. 18, 2020 [PCT/ISA/210].

*Primary Examiner* — Jillian K Pierorazio
(74) *Attorney, Agent, or Firm* — Sughrue Mion, PLLC

(57) ABSTRACT

An easy-to-wear functional shoe is disclosed. The easy-to-wear functional shoe according to an embodiment includes: a support member for supporting the heel of the functional shoe; and an elastic member coupled to the upper portion of the support member and formed to protrude from the support member toward the inside of the functional shoe.

14 Claims, 16 Drawing Sheets

(56) References Cited

U.S. PATENT DOCUMENTS 1,138,473 A * 5/1915 Hedgecock ..... A43B 23/28 36/58.5
1,174,619 A * 3/1916 Scholl ..... A43B 23/28 36/68
1,392,628 A * 10/1921 Drechsler ..... A43B 23/28 36/58.5
1,444,166 A * 2/1923 Coleman ..... A43B 23/28 36/58.5
1,566,791 A * 12/1925 Ekins ..... A43B 23/28 36/58.5
1,596,288 A * 8/1926 Miller ..... A43B 23/28 36/58.6
1,710,077 A * 4/1929 Scholl ..... A43B 23/28 36/55
1,712,420 A * 5/1929 Carlson ..... A43B 23/28 36/55
1,718,619 A * 6/1929 Watanabe ..... A43B 23/28 36/55
1,749,084 A * 3/1930 McCarthy ..... A43B 23/28 36/58.5
1,812,622 A * 6/1931 Costello ..... A43B 23/28 36/58.5
1,832,268 A * 11/1931 Waugh ..... A43B 23/28 36/55
1,895,141 A * 1/1933 Watanabe ..... A43B 23/28 36/55
1,946,591 A * 2/1934 Saito ..... A43B 23/08 36/55
2,088,976 A * 8/1937 Resnik ..... A43B 23/08 36/1
2,275,191 A * 3/1942 Schwartz ..... A43B 23/28 36/DIG. 1
2,379,384 A * 6/1945 Strasnick ..... A43B 23/08 36/12
2,495,929 A * 1/1950 Giersch ..... A43B 23/28 36/45
2,700,229 A * 1/1955 Dubin ..... A43B 23/28 36/58.5
4,503,628 A * 3/1985 Mancinelli ..... A43B 23/28 36/58.6
4,642,916 A * 2/1987 Collins ..... A43B 23/08 36/58.6
5,842,292 A * 12/1998 Siesel ..... A43B 23/28 36/71
6,101,655 A * 8/2000 Buddle ..... A43B 23/28 12/146 D
2015/0113830 A1* 4/2015 Dillinger ..... A43B 23/28 12/147 R
2016/0150852 A1* 6/2016 Cai ..... A43B 7/1485 36/88
2016/0183635 A1* 6/2016 Mancini ..... A43B 23/28 36/58.6
2017/0027285 A1* 2/2017 Mancini ..... A43B 23/28
2017/0127762 A1* 5/2017 Birrell ..... A43B 23/28
2017/0208901 A1* 7/2017 Liu ..... A43B 23/28
2018/0064204 A1* 3/2018 Vallon ..... A43B 23/28
2019/0045884 A1* 2/2019 Uda ..... A43B 23/0205
2019/0343219 A1* 11/2019 Vallon ..... A43B 23/28

FOREIGN PATENT DOCUMENTS

KR 10-2009-0130804 A 12/2009
KR 10-0976255 B1 8/2010
KR 10-2011-0104130 A 9/2011
KR 20-2016-0002454 U 7/2016
KR 10-1844276 B1 4/2018

* cited by examiner

[FIG. 1]
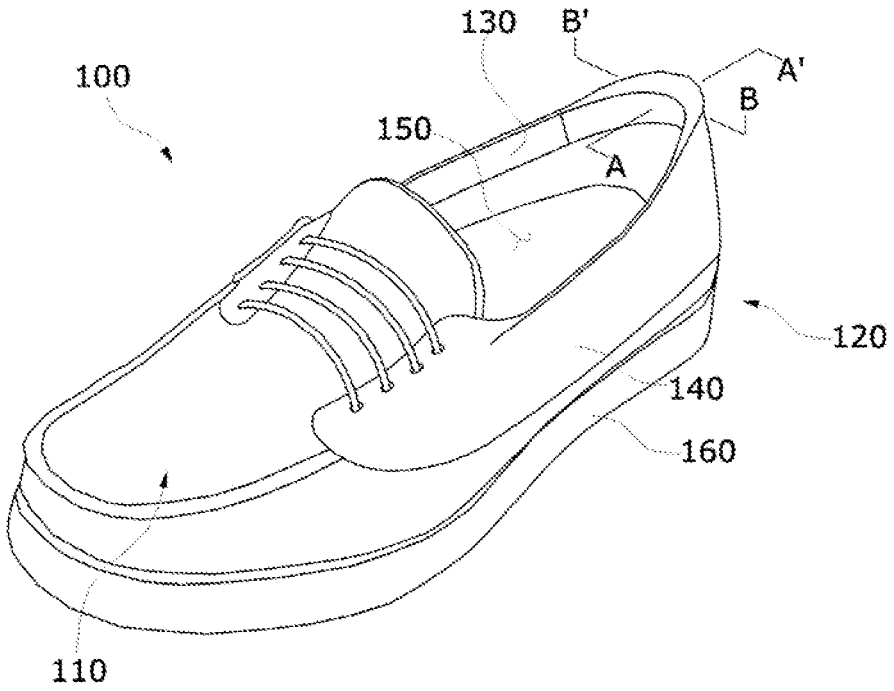

[FIG. 2]
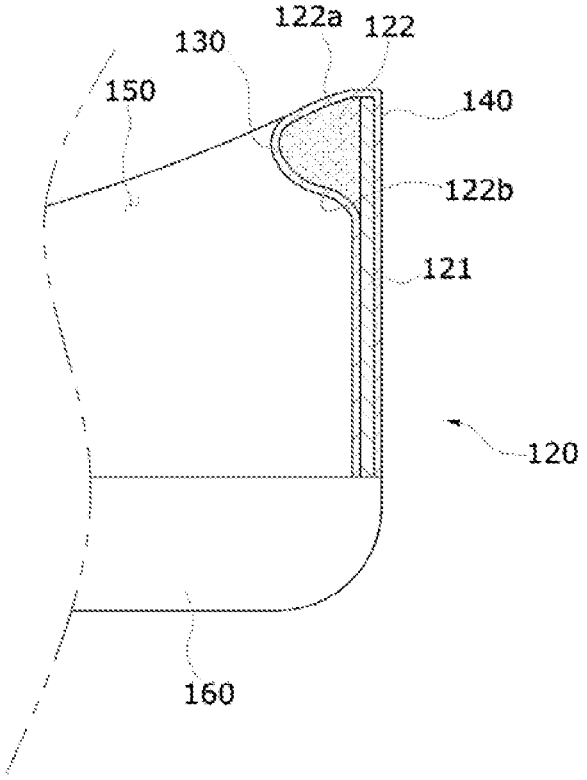

[FIG. 3]
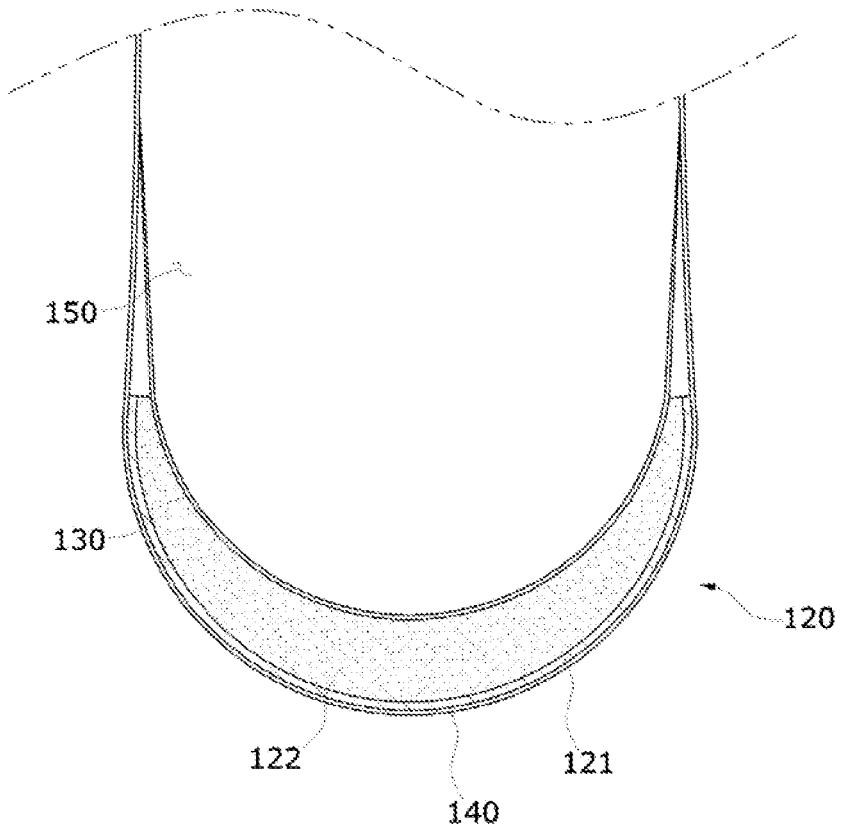

[FIG. 4]
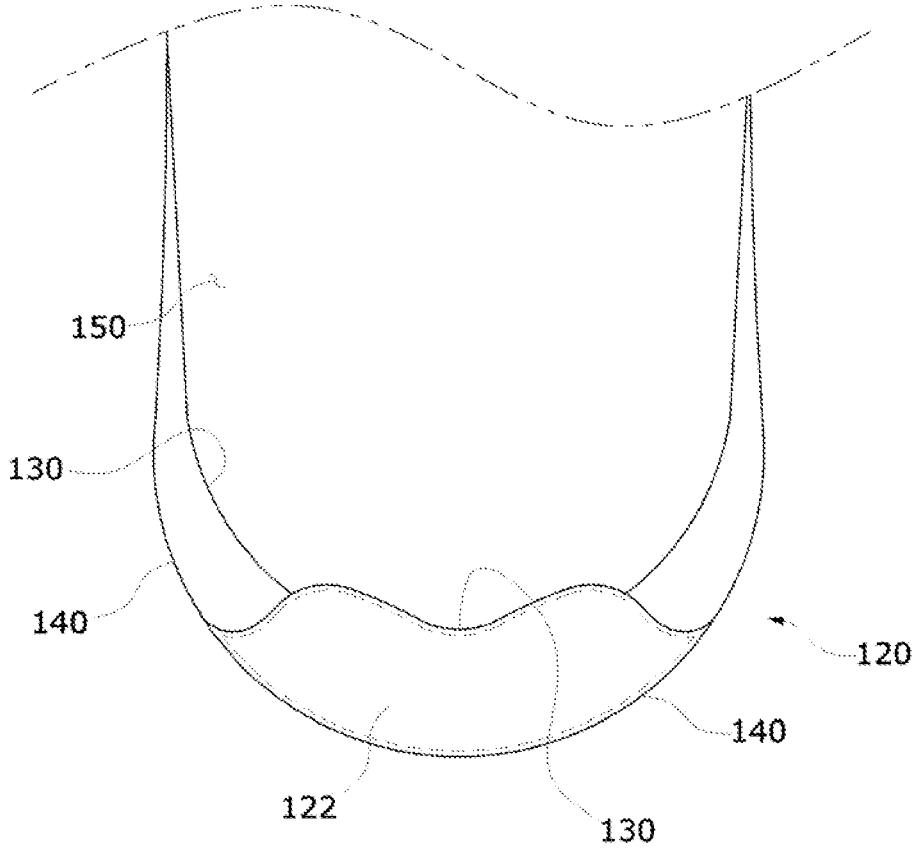

[FIG. 5]
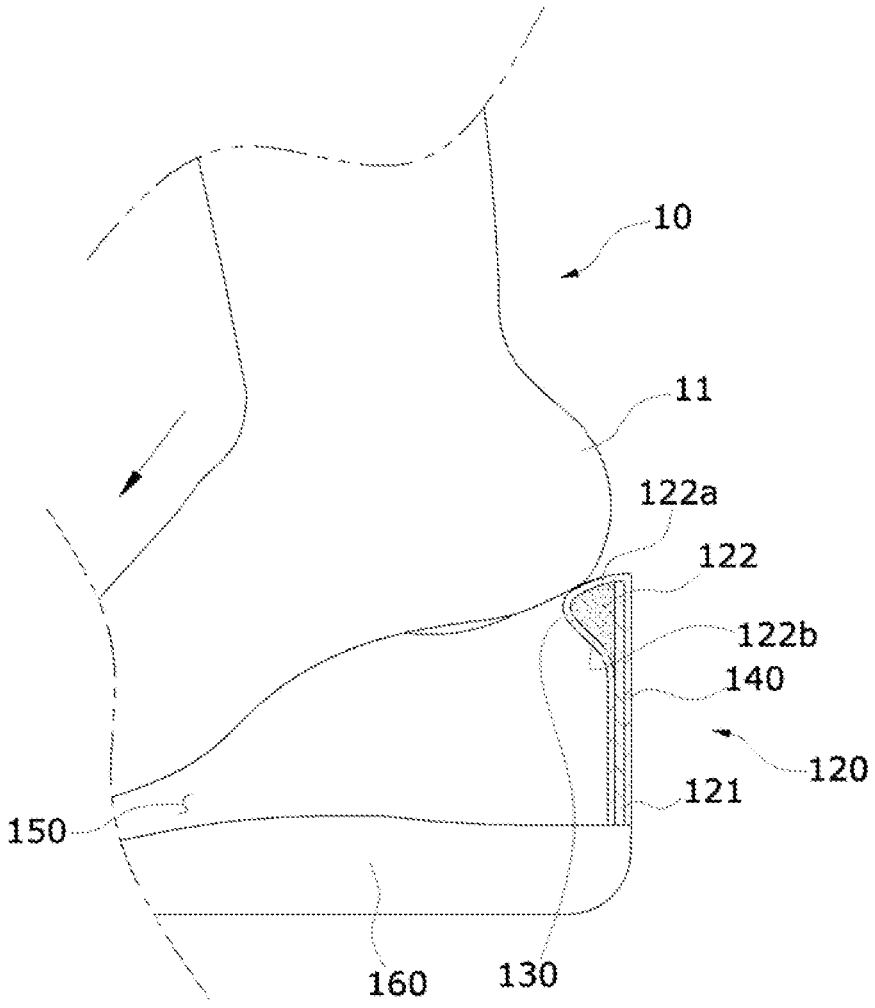

[FIG. 6]
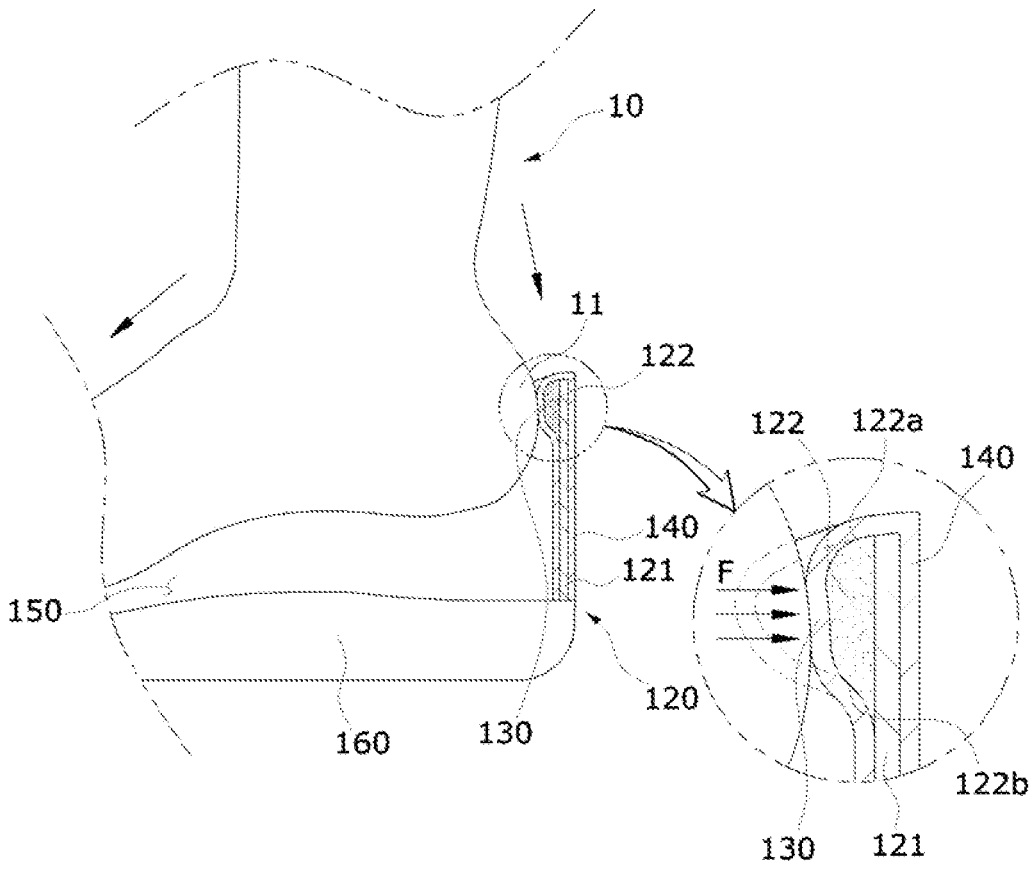

[FIG. 7]
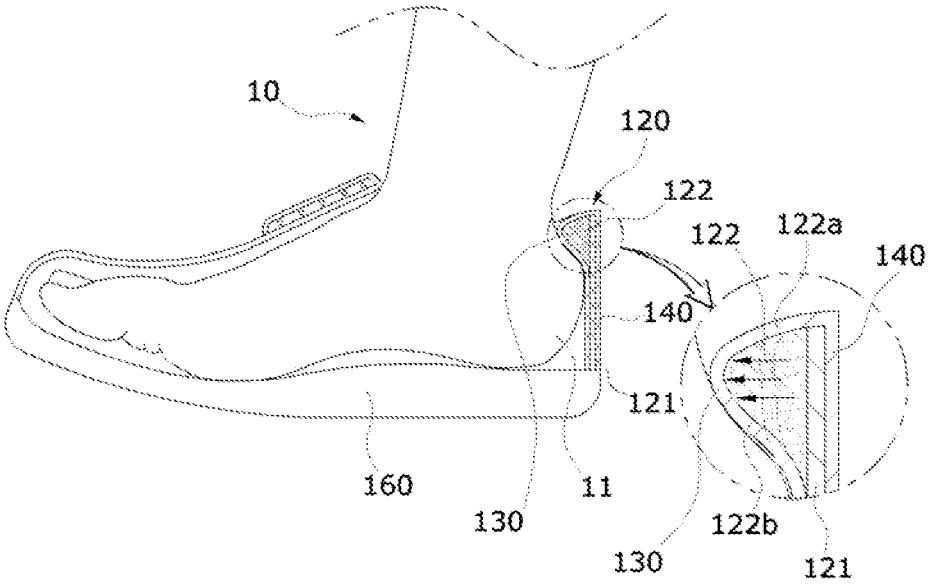

[FIG. 8]
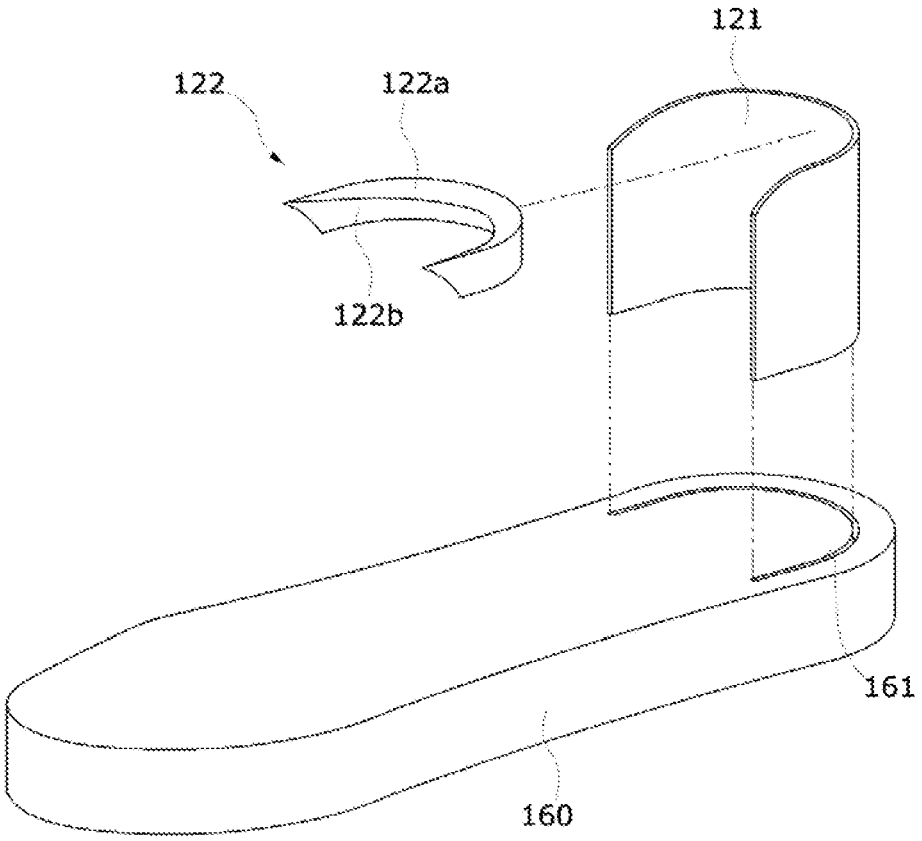

[FIG. 9]
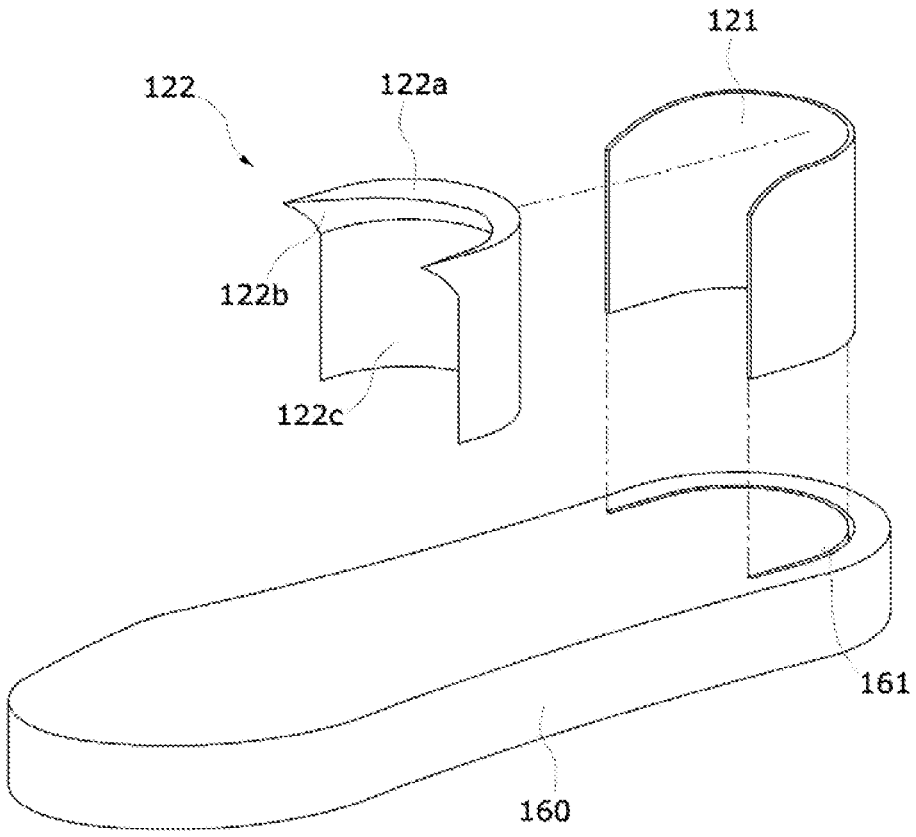

[FIG. 10]
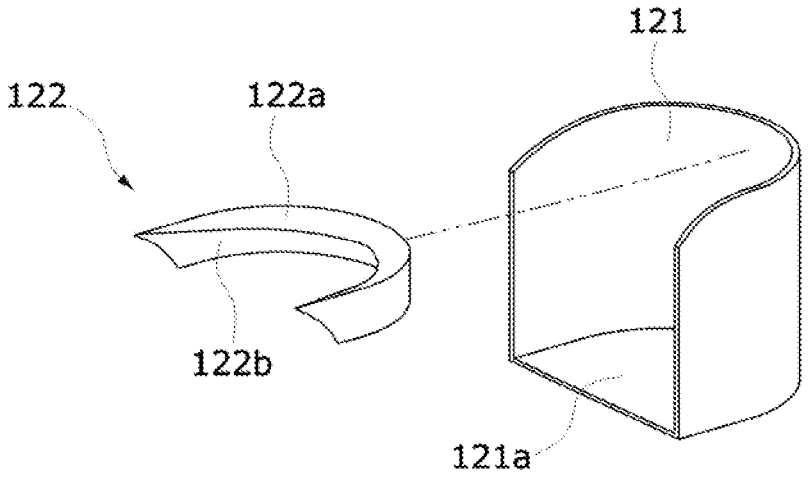

[FIG. 11]
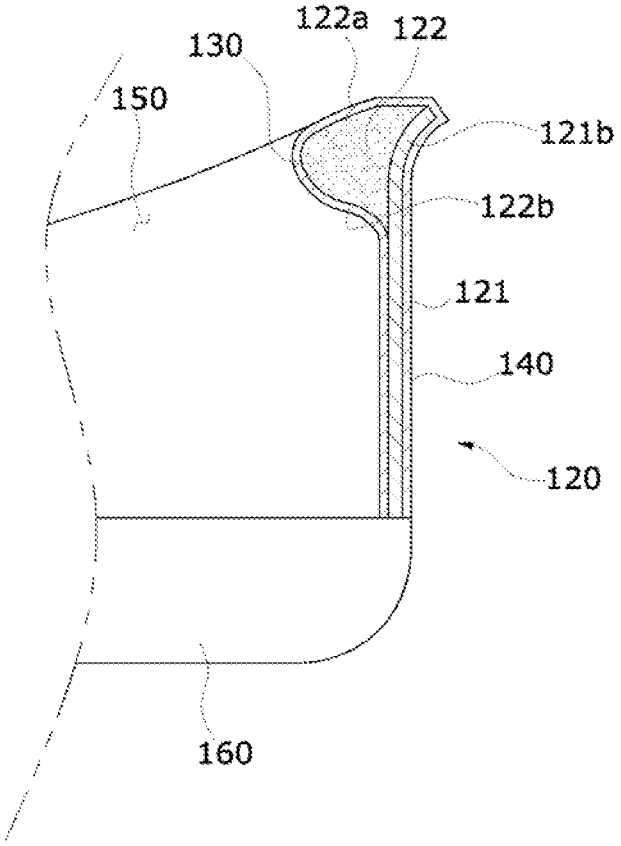

[FIG. 12]
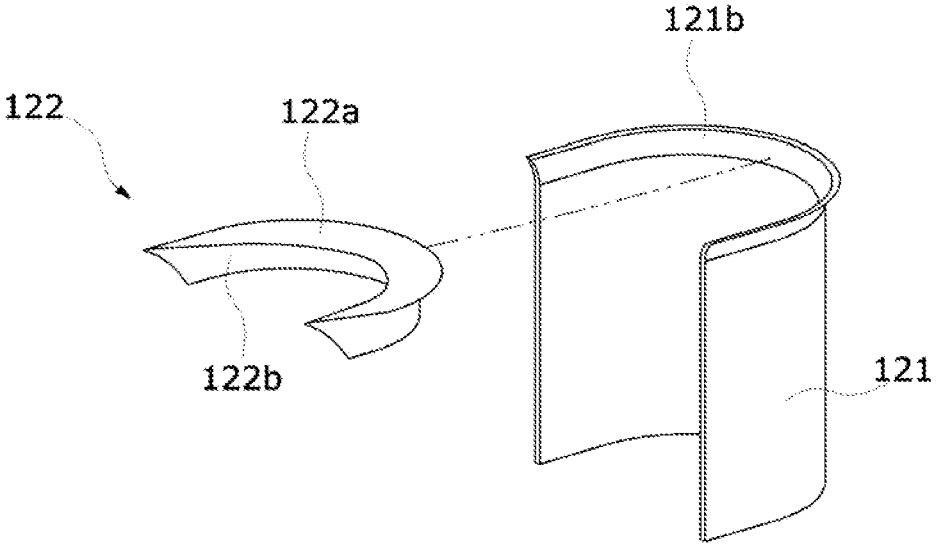
[FIG. 13]
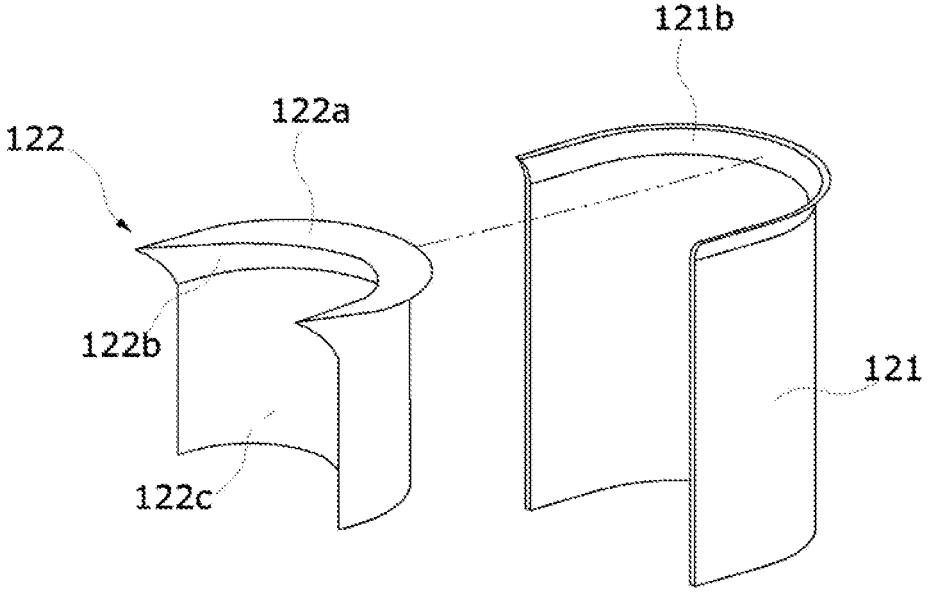

[FIG. 14]
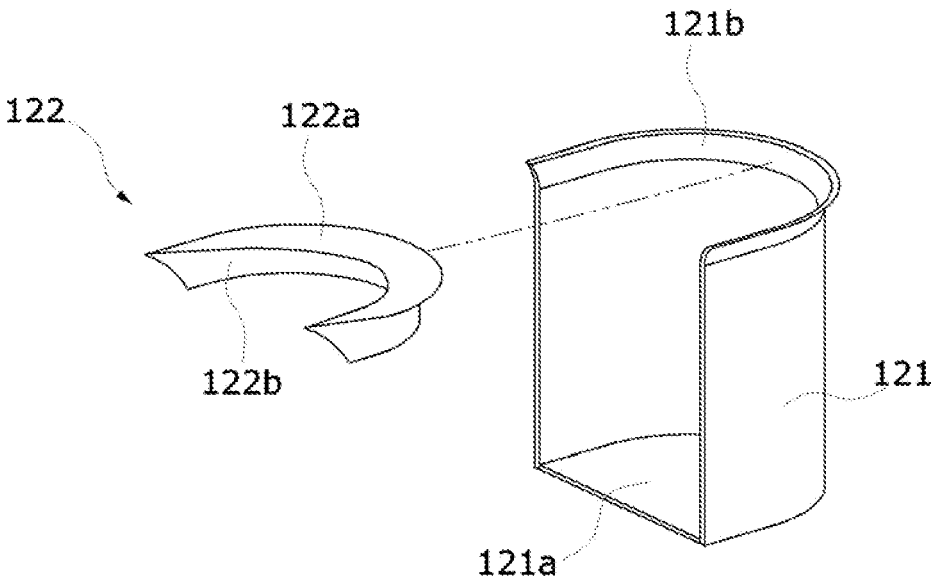

[FIG. 15]
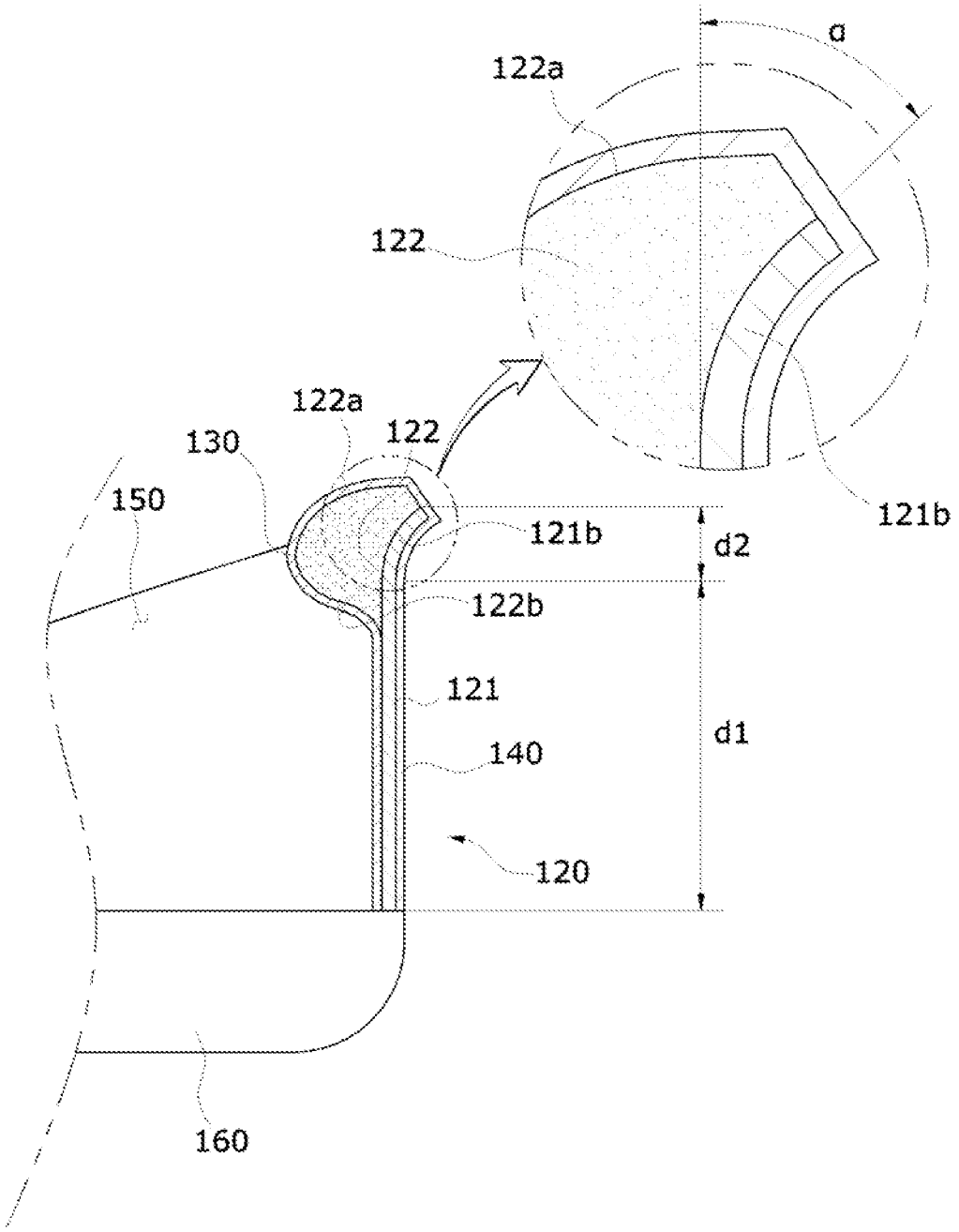

[FIG. 16]
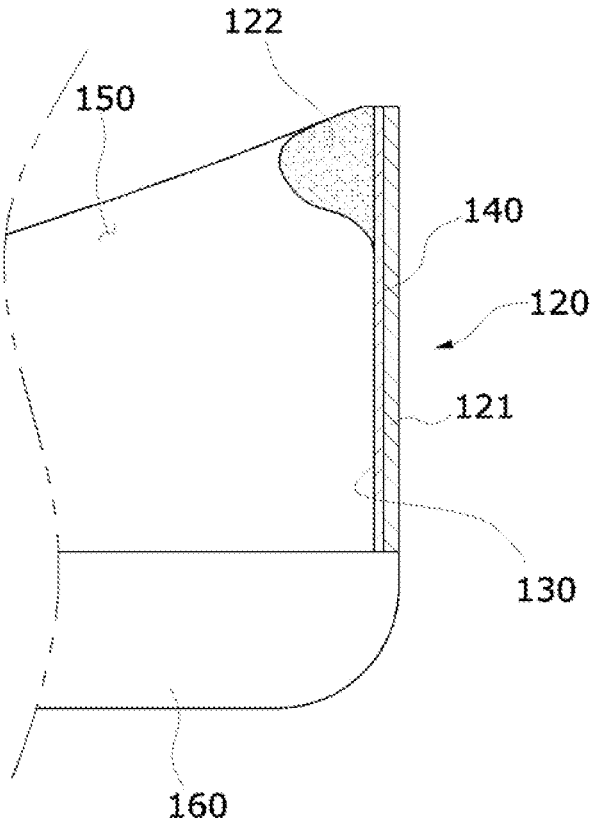
[FIG. 17]
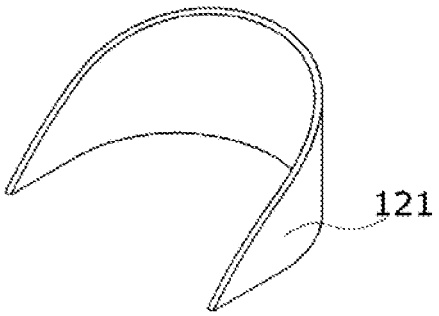

[FIG. 18]
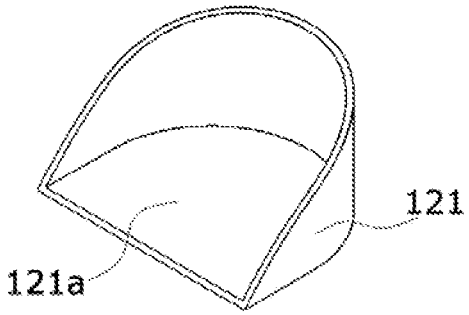

EASY-TO-WEAR FUNCTIONAL SHOE

TECHNICAL FIELD

The present invention relates to an easy-to-wear functional shoe.

BACKGROUND ART

In general, feet of a human body play an important role in supporting a weight of the human body while the feet are in contact with the ground when a user walks upright. Further, in recent years, in order to protect these feet, various functional shoes beneficial to health are being produced and sold.

The shoes are usually made of natural leather or a synthetic resin, and since the user usually prefers shoes that match his/her foot size, when the user puts on the shoes, the foot heel is caught on the shoe heel, thereby making it difficult to put on the shoe.

In particular, an upper end of the shoe heel of the general shoe is formed to be bent inward according to the shape of the foot heel, and thus the foot heel may be seated on the shoe when a wearer walks while wearing the shoes. However, accordingly, when the wearer puts on the shoes, there is a problem in that an upper end of the shoe heel is folded into the shoe or the foot is caught on the upper end of the shoe heel.

Therefore, in order for the wearer to easily put on the shoes, a shoelace has been tightened and unfastened or a finger or an auxiliary tool such as a shoehorn has been used.

However, to this end, in general, since the wearer should use his/her hand while his/her back is bent or the wearer sits, the wearer feels uncomfortable. In particular, it is not easy for a patient, who cannot bend his/her back or cannot use his/her hands freely, to put on the shoes.

Korean Patent Application Publication No. 10-0976255 (published on Aug. 18, 2010) is present as the related art document related to the present invention, and the related art document discloses a technology related to a shoe of which the shoe heel is automatically worn.

DISCLOSURE

Technical Problem

The present invention is directed to providing an easy-to-wear functional shoe that a wearer may easily put on without bending his/her waist and without using his/her finger or an auxiliary tool such as a shoehorn.

Technical Solution

One aspect of the present invention provides an easy-to-wear functional shoe including a support member that supports a shoe heel, and an elastic member that is coupled to an upper portion of the support member and protrudes inward from the functional shoe.

The support member may be substantially perpendicularly coupled to a sole.

The support member may have a semicircular arch shape surrounding the shoe heel.

The support member may be formed up to an upper end of the shoe heel.

The elastic member may be elastically deformed in a front-rear direction according to an external force caused by being in contact with a foot heel of a wearer.

The elastic member may be made of any one of rubber and urethane.

The support member may be made of a material having hardness sufficient to not allow the shoe heel to fold inward even by the external force applied by the wearer.

The support member may be made of a reinforced plastic material.

The support member may further include a bottom surface coupled to the sole.

The support member may be coupled to a slot provided in the sole.

The elastic member may include a wearing surface that is inclined inward in a direction toward a lower side and a seating surface that protrudes from a lower end of the wearing surface, is inclined outward in a direction toward the lower side, and surrounds a foot heel.

The elastic member may further include a protective surface extending downward from the seating surface.

An inclined section extending outward may be formed at an upper end of the support member.

The support member and the elastic member may be provided between an inner skin and an outer skin of the shoe heel.

Another aspect of the present invention provides an easy-to-wear functional shoe having a shoe heel and a sole which are surrounded by an inner skin and an outer skin, the functional shoe including a support member that is provided between the inner skin and the outer skin and supports the shoe heel, and an elastic member that is provided between the inner skin and the outer skin, is coupled to an upper portion of the support member, and protrudes inward from the functional shoe.

Here, the support member may be substantially perpendicularly coupled to the sole.

Advantageous Effects

The present invention can provide an easy-to-wear functional shoe having a support member and an elastic member so that, when putting on the shoes, the wearer can easily put on the shoes without bending his/her waist or without using his/her hand.

In particular, the support member is made of a hard material so that a shoe heel is prevented from being bent into the shoe by an external force applied by the wearer, the elastic member is elastically deformed in a front-rear direction according to the external force applied by the wearer, and thus the wearer can easily put on the shoe without bending his/her waist or without using an assistive device.

Further, since an upper end of the shoe heel is not bent into the shoe due to the support member, when the wearer puts on the shoe, a foot heel can be prevented from being injured or the shoe can be prevented from being bent inward.

In addition, even in the case of a disabled patient, the patient can put on or take off the shoe by himself/herself without the help of another person, and thus his/her quality of life can be improved.

DESCRIPTION OF DRAWINGS

FIG. 1 is a perspective view schematically illustrating an easy-to-wear functional shoe according to one embodiment of the present invention.

FIG. 2 is a cross-sectional view taken along line A-A' of FIG. 1.

FIG. 3 is a cross-sectional view taken along line B-B' of FIG. 1.

FIG. 4 is a plan view schematically illustrating a modification of an elastic member in the easy-to-wear functional shoe according to one embodiment of the present invention.

FIGS. 5 to 7 are views schematically illustrating a state in which a wearer puts on the easy-to-wear functional shoe according to one embodiment of the present invention.

FIG. 8 is a schematic view for describing a support member and an elastic member in the easy-to-wear functional shoe according to one embodiment of the present invention.

FIG. 9 is a schematic view illustrating a modification of the elastic member in the easy-to-wear functional shoe according to one embodiment of the present invention.

FIG. 10 is a schematic view illustrating a modification of the support member in the easy-to-wear functional shoe according to one embodiment of the present invention.

FIG. 11 is a cross-sectional view of an easy-to-wear functional shoe according to another embodiment of the present invention.

FIG. 12 is a schematic view for describing a support member and an elastic member in the easy-to-wear functional shoe according to another embodiment of the present invention.

FIG. 13 is a schematic view illustrating a modification of the elastic member in the easy-to-wear functional shoe according to another embodiment of the present invention.

FIG. 14 is a schematic view illustrating a modification of the support member in the easy-to-wear functional shoe according to another embodiment of the present invention.

FIG. 15 is a cross-sectional view illustrating the modification of the elastic member in the easy-to-wear functional shoe according to another embodiment of the present invention.

FIG. 16 is a cross-sectional view of an easy-to-wear functional shoe according to still another embodiment of the present invention.

FIGS. 17 and 18 are schematic views illustrating a modification of a support member in the easy-to-wear functional shoe according to still another embodiment of the present invention.

MODES OF THE INVENTION

Advantages and features of the present invention and a method of achieving the advantages and the features will become apparent with reference to embodiments described below in detail together with the accompanying drawings. However, the present invention is not limited to the embodiments described below but will be implemented in various forms, and the present embodiments merely make the invention of the present invention complete, are provided to completely inform the scope of the present invention to those skilled in the art to which the present invention belongs, and are defined by the description of the appended claims. Meanwhile, terms used in the present specification are intended to describe the embodiments and are not intended to limit the present invention. In the present specification, a singular form also includes a plural form unless specifically mentioned in a phrase. The term "comprise" or "comprising" used herein does not exclude the presence or addition of one or more other components, steps, operations, and/or elements in addition to components, steps, operations, and/or elements mentioned above.

Hereinafter, exemplary embodiments of the present invention will be described in detail with reference to the accompanying drawings.

FIG. 1 is a perspective view schematically illustrating an easy-to-wear functional shoe according to one embodiment of the present invention.

Referring to FIG. 1, an easy-to-wear functional shoe 100 includes a fore sole 110 and a shoe heel 120 which are surrounded by an inner skin 130 and an outer skin 140.

The easy-to-wear functional shoe 100 includes a wearing groove 150, on which a foot of the wearer is seated, and a sole 160.

FIG. 2 is a cross-sectional view taken along line A-A' of FIG. 1, and FIG. 3 is a cross-sectional view taken along line B-B' of FIG. 1.

Referring to FIGS. 2 and 3, in the easy-to-wear shoe 100 (see FIG. 1) according to the present invention, the shoe heel 120 includes a support member 121 and an elastic member 122.

The support member 121 is provided between the inner skin 130 and the outer skin 140. The support member 121 functions to support the shoe heel 120. In this case, the support member 121 may be made of reinforced plastic that is a material that does not allow the shoe heel 120 to break or bend forward (inward direction) due to an external force applied by the wearer.

Here, the reinforced plastic is a plastic that compensates for the disadvantages of the plastic that is weak to heat and impact and refers to a plastic reinforced using a reinforcing material such as glass fiber or carbon fiber.

The support member 121 is coupled to the sole 160 so that the shoe heel 120 is substantially vertical. In this case, as illustrated in FIG. 3, the support member 121 is formed in a semicircular arc shape to surround and support the shoe heel 120.

Here, the semicircular arc shape is not necessarily limited to a semicircle and includes various shapes according to an extension length of a side surface of the support member 121. In this case, the support member 121 may be formed up to an upper end of the shoe heel 120.

The elastic member 122 is provided between the inner skin 130 and the outer skin 140. The elastic member 122 protrudes from the support member 121 in an inward direction. In this case, the inward direction refers to an inner side on which the wearing groove 150 is located.

The elastic member 122 adheres to an inner upper end of the support member 121. In this case, the elastic member 122 is provided with a wearing surface 122*a* and a seating surface 122*b*.

The wearing surface 122*a* is a section protruding from the upper end of the support member 121 and inclined inward in a direction toward the lower side. The wearing surface 122*a* guides the foot of the wearer to the wearing groove 150 so that the foot heel of the wearer may be easily moved into the wearing groove 150.

The seating surface 122*b* is connected to a lower end of the wearing surface 122*a*. The seating surface 122*b* is a section inclined outward in a direction toward the lower side. Here, the outward direction refers to an outer side with respect to the wearing groove 150.

When the wearer fully puts his/her foot into the wearing groove 150, the seating surface 122*b* surrounds an ankle of the wearer so that the shoe is not easily taken off.

FIG. 4 is a plan view schematically illustrating a modification of an elastic member in the easy-to-wear functional shoe according to one embodiment of the present invention.

Referring to FIG. 4, the elastic member 122 may be formed at an upper end of a central part of the shoe heel 120 of the shoe. Here, the central part of the shoe heel 120 comprehensively refers to a part formed with respect to a center of the shoe heel 120.

In this case, the elastic member 122 may be formed only at the upper end of the central part of the shoe heel 120. Thus, in the embodiment of the FIG. 4, there is no elastic member 122 in the inner skin 130 and the outer skin 140 on left and right sides with respect to the central part of the shoe heel 120. The elastic member 122 in this structure may protect or seat only the foot heel when the wearer puts the foot into the wearing groove 150.

FIGS. 5 to 7 are views schematically illustrating a state in which a wearer puts on the easy-to-wear functional shoe according to one embodiment of the present invention.

First, referring to FIG. 5, in the easy-to-wear functional shoe that is the present invention, the shoe heel 120 is provided with the support member 121 and the elastic member 122, and thus when the wearer puts on the shoe, the wearer may easily put on the shoe without bending his/her waist or using his/her hands.

When the wearer inserts a foot 10 into the wearing groove 150 to put on the shoe, a foot heel 11 comes into contact with the inner skin 130 surrounding the elastic member 122.

In this case, as illustrated in FIG. 6, when the foot heel 11 of the wearer applies an external force F to the inner skin 130, the elastic member 122 provided in the inner skin 130 is elastically deformed by a pushing force of the foot heel 11.

That is, the elastic member 122 is elastically deformed by the external force F caused by the contact with the foot heel 11 and is recessed in an outward direction. Here, the outward direction refers to an outer side with respect to the wearing groove 150.

The elastic member 122 that is elastically deformable in this way may be made of a rubber material. In addition, the elastic member 122 may be made of a highly elastic material such as urethane having elasticity.

Although the shape of the support member 121 is not basically deformed, the support member 121 may be elastically deformed in the outward direction (outer side) so that the wearer may easily put on the shoes. However, the support member 121 is not deformed in an inward direction.

The support member 121 may be made of a reinforced plastic material. Here, the support member 121 may not be easily broken by an external force.

Referring to FIG. 7, when the wearer puts on the shoes, the foot 10 of the wearer is seated on the wearing groove 150 (see FIG. 6). In this case, the elastic member 122 is restored to an original shape again after the foot heel 11 of the wearer has passed therethrough.

The foot heel 11 of the wearer is seated on the seating surface 122*b* of the elastic member 122 restored in this way so that the foot 10 of the wearer is not easily separated to the outside. In this case, the seating surface 122*b* has a form that surrounds the ankle of the wearer who wears the shoes.

When the wearer takes off the shoe, when the wearer fixes the shoe heel 120 and lifts the foot heel 11, the wearing groove 150 is widened while the elastic member 122 is compressed, and thus the foot 10 may be easily separated from the shoe.

FIG. 8 is a schematic view for describing a support member and an elastic member in the easy-to-wear functional shoe according to one embodiment of the present invention.

Referring to FIG. 8, the support member 121 is fitted in a slot 161 having a semicircular arch shape and provided in the sole 160 so that the shoe heel 120 is vertical. In this case, the support member 121 has a semicircular arch shape corresponding to the slot 161.

The elastic member 122 protrudes from the upper end of the support member 121 in an inward direction. In this case, the elastic member 122 is coupled to the inner upper end of the support member 121. Here, the elastic member 122 and the support member 121 may be coupled in one of adhesion, Velcro detachable coupling, and uneven coupling methods.

FIG. 9 is a schematic view illustrating a modification of the elastic member in the easy-to-wear functional shoe according to one embodiment of the present invention.

Referring to FIG. 9, the elastic member 122 protrudes inward from the support member 121. In this case, the elastic member 122 includes a wearing surface 122*a*, a seating surface 122*b*, and a protective surface 122*c*.

The wearing surface 122*a* is a section inclined inward in a direction toward the lower side.

The seating surface 122*b* is a section connected to a lower end of the wearing surface 122*a* and inclined outward in a direction toward the lower side.

The protective surface 122*c* refers to a section extending downward from the seating surface 122*b*. The protective surface 122*c* improves wearing sensation of the foot heel 11. In this case, the protective surface 122*c* may extend up to the slot 161 having a semicircular arch shape and provided in the sole 160 and may thus be coupled to the slot 161.

Here, the protective surface 122*c* may be coupled to the slot 161 together while adhering to the support member 121.

FIG. 10 is a schematic view illustrating a modification of the support member in the easy-to-wear functional shoe according to one embodiment of the present invention.

Referring to FIG. 10, the support member 121 has a semicircular arch shape surrounding the shoe heel 120. A bottom surface 121*a* that is adhesively coupled to the sole 160 is integrally formed at a lower end of the support member 121.

The bottom surface 121*a* has a shape forming a bottom plate of the support member 121 and also functions to supplement the strength so that the support member 121 may maintain the shape.

Further, the bottom surface 121*a* may be formed to be fitted in or unevenly coupled to the sole 160.

FIG. 11 is a cross-sectional view of an easy-to-wear functional shoe according to another embodiment of the present invention, and FIG. 12 is a schematic view for describing a support member and an elastic member.

Referring to FIGS. 11 and 12 together, the upper end of the support member 121 is bent outward in the shoe heel 120 of the easy-to-wear functional shoe according to another embodiment of the present invention.

That is, an inclined section 121*b* extending outward is provided at the upper end of the support member 121. The inclined section 121*b* may more effectively couple the elastic member 122 by increasing an adhesive force.

In other words, when the foot heel 11 of the wearer presses the inner skin 130 surrounding the wearing surface 122*a* of the elastic member 122, a load is applied to the elastic member 122 rearward or downward.

In this case, the inclined section 121*b* supports the elastic member 122. At the same time, the inclined section 121*b* is formed in a shape inclined outward in a direction toward the upper side with respect to the upper end of the support member 121.

Accordingly, the inclined section 121*b* may guide a wearing path so that the foot 10 of the wearer may easily slide into the wearing groove 150.

Further, the inclined section 121*b* may be formed up to the upper end of the shoe heel 120 so that the shoe heel 120 is not bent. Thus, the upper end of the shoe heel 120, that is, a portion thereof in contact with the foot heel 11 of the wearer, is prevented from being bent due to the inclined section 121*b*, and thus the wearer may easily put on the shoes.

FIG. 13 is a schematic view illustrating a modification of the elastic member in the easy-to-wear functional shoe according to another embodiment of the present invention.

Referring to FIG. 13, the elastic member 122 protrudes inward from the support member 121. In this case, the elastic member 122 includes the wearing surface 122*a*, the seating surface 122*b*, and the protective surface 122*c*.

Among the listed components, the already described contents are duplicated and thus will be omitted. Thus, only modified parts will be described.

The wearing surface 122*a* of the elastic member 122 has a shape that is convex inward and concave outward. In this case, an outer surface of the wearing surface 122*a* has a shape corresponding to an inner surface of the inclined section 121*b* of the support member 121.

Accordingly, the elastic member 122 may be more firmly coupled to the support member 121.

Meanwhile, the protective surface 122*c* is coupled to the entire support member 121 having a semicircular arch shape and thus may attenuate an impact transmitted to the foot heel 11 of the wearer.

FIG. 14 is a schematic view illustrating a modification of the support member in the easy-to-wear functional shoe according to another embodiment of the present invention.

Referring to FIG. 14, the support member 121 having a semicircular arch shape and surrounding the shoe heel 120 may be provided with a bottom surface 121*a*.

The bottom surface 121*a* has a shape forming a bottom plate of the support member 121 and also functions to supplement the strength so that the support member 121 may maintain the shape.

Further, the bottom surface 121*a* may be formed to be fitted in or unevenly coupled to the sole 160.

FIG. 15 is a sectional-sectional view illustrating the modification of the elastic member in the easy-to-wear functional shoe according to another embodiment of the present invention.

Referring to FIG. 15, the elastic member 122 is adhesively coupled to an upper end of the inclined section 121*b*. In this case, the elastic member 122 may be provided to protrude to the upper end of the shoe heel 120.

The elastic member 122 has a structure protruding toward the upper end and the front side with respect to the shoe heel 120, and thus the present invention provides the effect of preventing a heel injury that may occur when the wearer puts on or takes off the shoe.

Here, in order for the wearer to easily put on or take off the shoe, the elastic member 122 should be elastically deformed in a state in which the shoe heel 120 maintains the shape. Thus, an angle a of the inclined section 121*b* formed at the upper surface of the support member 121 may be an obtuse angle.

In general, when the wearing groove 150 is wide or the shoe heel 120 is low, the wearer may easily put on or take off the shoe. To this end, in the present invention, lengths d1 and d2 of the shoe heel 120 may be lowered by 5 to 10 mm more than in other embodiments, and the elastic member 122 may be formed to protrude from the upper end of the support member 121 by the lowered lengths.

In this case, the lengths d1 and d2 of the shoe heel 120 and the length of the support member 121 may be the same. This is because the shoe heel 120 may effectively maintain the shape only when the lengths d1 and d2 of the shoe heel 120 and the length of the support member 121 are the same.

FIG. 16 is a sectional-sectional view of an easy-to-wear functional shoe according to still another embodiment of the present invention.

Referring to FIG. 16, the support member 121 may be formed not between the inner skin 130 and the outer skin 140 of the shoe heel 120 but outside the outer skin 140.

The support member 121 may be formed integrally with the inner skin 130 and the outer skin 140 of the shoe heel 120.

The elastic member 122 may be formed but between the inner skin 130 and the outer skin 140 of the shoe heel 120 but inside the inner skin 130 and thus may come into direct contact with the foot heel 11.

Here, the elastic member 122 may be formed to be detachably attached to the inner skin 130.

That is, since the foot heel 11 of the wearer may come into contact with the elastic member 122 by itself, the elastic member 122 may be detachably attached to the inner skin 130 to enable washing of the shoe. In this case, the elastic member 122 and the inner skin 130 may be detachably attached in the form of Velcro or may be detachably attached in the form capable of uneven coupling.

FIGS. 17 and 18 are schematic views illustrating a modification of a support member in the easy-to-wear functional shoe according to still another embodiment of the present invention.

First, referring to FIG. 17, the support member 121 has a semicircular arch shape. The support member 121 has a shape having both ends inclined downward in a direction toward the inner side with respect to a heel.

Accordingly, the heel of the support member 121 is formed to have a length corresponding to the shoe heel 120 of the shoe, but both ends of the support member 121 are formed to surround only a portion of a section next to the shoe heel 120 of the shoe.

Next, referring to FIG. 18, the support member 121 may include the bottom surface 121*a*.

The bottom surface 121*a* has a shape forming a bottom plate of the support member 121 and also functions to supplement the strength so that the support member 121 may maintain the shape.

Further, the bottom surface 121*a* may be formed to be fitted in or unevenly coupled to the sole 160.

Meanwhile, although not illustrated, the support member 121 may be provided between the inner skin 130 and the outer skin 140, and the elastic member 122 may be detachably attached to the support member 121 outside the inner skin 130 and the outer skin 140. That is, the elastic member 122 may be formed to cover the upper end of the support member 121 formed in a semicircular arch shape.

In other words, the elastic member 122 may include a jig (not illustrated) at a connection part between the support member 121 and the elastic member 122 to be connected to the support member 121. The jig may be provided on one side of the elastic member 122 and fit the elastic member 122 in the support member 121.

Here, a portion of the support member 121, which is coupled to the jig, is formed to have a size corresponding to the jig. Thus, the support member 121 may be provided with a separate fitting groove (not illustrated) to which the jig is connected.

The fitting groove may be provided at a portion of the upper end of the heel of the support member 121 and have a structure which the jig of the elastic member 122 is fitted in and inserted into.

The present invention is not limited to the above-described embodiments and can be variously modified and implemented without departing from the allowable scope of the technical spirit of the present invention.

INDUSTRIAL APPLICABILITY

As described above, the embodiments of the present invention may be applied to a functional shoe which a wearer may easily put on without bending his/her waist or using his/her hand when putting on the shoe.

The invention claimed is:

1. An easy-to-wear functional shoe having a shoe heel and a sole, the functional shoe comprising:

a support member that supports the shoe heel; and an elastic member that is coupled to an upper portion of the support member and protrudes inward from the functional shoe, wherein the support member is substantially perpendicularly directly coupled to the sole at a lower end of the support member, wherein an amount of a portion of the elastic member protruded from the support member gradually decreases toward side edges of the shoe heel in a plan view of the functional shoe, wherein the support member has a semicircular arch shape surrounding the shoe heel, wherein an entire region of the lower end of the support member is coupled to a slot provided in the sole, wherein the elastic member includes:

a wearing surface that is inclined inward in a direction toward a lower side of the functional shoe; and a seating surface that is inclined outward in a direction toward the lower side, and surrounds a foot heel, wherein an upper end of the wearing surface contacts the support member, a lower end of the wearing surface contacts an upper end of the seating surface, and a lower end of the seating surface contacts the support member, wherein the elastic member further includes a protective surface extending downward from both ends of left and right sides of the seating surface, and wherein an angle formed between the wearing surface and a horizontal line, which is parallel to the ground and passes through a contact point of the wearing surface and the searing surface is smaller than an angle formed between the seating surface and the horizontal line.

2. The easy-to-wear functional shoe of claim 1, wherein the support member is formed up to an upper end of the shoe heel.

3. The easy-to-wear functional shoe of claim 1, wherein the elastic member is elastically deformed in a front-rear direction according to an external force caused by being in contact with a foot heel of a wearer.

4. The easy-to-wear functional shoe of claim 1, wherein the elastic member is made of any one of rubber and urethane.

5. The easy-to-wear functional shoe of claim 1, wherein the support member is made of a material having hardness sufficient to not allow the shoe heel to fold inward even by an external force applied by a wearer.

6. The easy-to-wear functional shoe of claim 1, wherein the support member is made of a reinforced plastic material.

7. The easy-to-wear functional shoe of claim 1, wherein an inclined section extending outward is formed at an upper end of the support member.

8. The easy-to-wear functional shoe of claim 1, wherein the support member and the elastic member are provided between an inner skin and an outer skin of the shoe heel.

9. The easy-to-wear functional shoe of claim 1, wherein the support member is made of carbon fiber.

10. The easy-to-wear functional shoe of claim 1, wherein the support member is substantially a rectangular shape.

11. The easy-to-wear functional shoe of claim 1, wherein the support member is substantially a rectangular shape with curved upper left and right corners.

12. An easy-to-wear functional shoe having a shoe heel and a sole, the functional shoe comprising:

a support member that supports the shoe heel; and an elastic member that is coupled to an upper portion of the support member and protrudes inward from the functional shoe, wherein the support member is substantially perpendicularly directly coupled to the sole at a lower end of the support member, wherein an amount of a portion of the elastic member protruded from the support member gradually decreases toward side edges of the shoe heel in a plan view of the functional shoe, wherein the support member has a semicircular arch shape surrounding the shoe heel, wherein an entire region of the lower end of the support member is coupled to a slot provided in the sole, and wherein an amount of a portion of the elastic member protruded from the support member at an upper end of the elastic member gradually decreases toward a lower end of the elastic member in a side view of the functional shoe.

13. An easy-to-wear functional shoe having a shoe heel and a sole, the functional shoe comprising:

a support member that supports the shoe heel; and an elastic member that is coupled to an upper portion of the support member and protrudes inward from the functional shoe, wherein the support member is substantially perpendicularly directly coupled to the sole at a lower end of the support member, wherein an amount of a portion of the elastic member protruded from the support member gradually decreases toward side edges of the shoe heel in a plan view of the functional shoe, wherein the support member has a semicircular arch shape surrounding the shoe heel, wherein an entire region of the lower end of the support member is coupled to a slot provided in the sole, wherein the elastic member includes:

a wearing surface that is inclined inward in a direction toward a lower side of the functional shoe; and a seating surface that is inclined outward in a direction toward the lower side, and surrounds a foot heel, wherein an upper end of the wearing surface contacts the support member, a lower end of the wearing surface contacts an upper end of the seating surface, and a lower end of the seating surface contacts the support member, wherein the elastic member further includes a protective surface extending downward from both ends of left and right sides of the seating surface, and wherein the wearing surface has a shape that is convex inward and concave outward.

14. The easy-to-wear functional shoe of claim 13, wherein the support member comprises an inclined section at the upper portion of the support member, and an outer surface of the wearing surface has a shape corresponding to an inner surface of the inclined section of the support member.

* * * * *